United States Patent [19]

Scherer

[11] 4,010,438

[45] Mar. 1, 1977

[54] TERMINATOR MEMBER FOR FUSIBLE ELEMENT OF A HIGH VOLTAGE FUSE

[75] Inventor: Henry W. Scherer, Mount Prospect, Ill.

[73] Assignee: S & C Electric Company, Chicago, Ill.

[22] Filed: Nov. 19, 1975

[21] Appl. No.: 633,486

[52] U.S. Cl. ..... 337/232; 337/252; 337/291; 339/275 T

[51] Int. Cl.[2] ..... H01H 85/38

[58] Field of Search ..... 337/158, 159, 231, 232, 337/234, 248, 251–254, 291, 295; 339/275 R, 275 A, 275 T; 228/165, 174

[56] References Cited

UNITED STATES PATENTS

| | | | |
|---|---|---|---|
| 3,337,947 | 8/1967 | Terrill et al. | 228/165 |
| 3,437,971 | 4/1969 | Mikulecky | 337/158 |
| 3,489,979 | 1/1970 | Belcher | 337/158 |
| 3,801,945 | 4/1974 | Howard | 337/159 |
| 3,825,870 | 7/1974 | Ono et al. | 337/159 X |

*Primary Examiner*—George Harris
*Attorney, Agent, or Firm*—Kirkland & Ellis

[57] ABSTRACT

A metallic terminator member is mounted at each end of a support member for a fusible element of a high-voltage fuse. Each terminator member has a serrated tab projecting into the normal path of the fusible element so that the fusible element can be easily welded to the serrated tab without being distorted and at reduced welding temperatures to avoid damage to the fusible element. The terminator members also have positioning fingers that position the terminator member within the fuse housing and a tab for attaching the terminator member to the end ferrules of the fuse. The terminator members also include a center keyed opening that receives the support member and positions and retains the support member. A wire retainer can be used to engage grooves in the ends of the support member that extend through the keyed opening to lock the terminator member to the support member.

2 Claims, 7 Drawing Figures

TERMINATOR MEMBER FOR FUSIBLE ELEMENT OF A HIGH VOLTAGE FUSE

BACKGROUND OF THE INVENTION

1. Field of the Invention

The present invention relates to high voltage fuse construction, and more particularly to support assemblies for supporting fusible elements in high voltage fuses.

2. Description of the Prior Art

High voltage current limiting fuses are well known to the art. Prior art current limiting fuses typically comprise a hollow insulated cylindrical housing which is closed at both ends by metallic end walls. A helically wound fusible element is positioned within the housing and is connected to the end walls. The current limiting fuses are typically filed with an electrically non-conducting insulating material such as silica or quartz sand which surrounds the fusible element. Since it is necessary to assume that the fusible element maintains the proper distance from the sides of the insulated housing and that the individual turns of the fusible element are maintained at a uniform distance to assure that there is no arcing between the turns, prior art current limiting fuses have typically included a support assembly for supporting the fusible element within the fuse housing.

Difficulty has been experienced in prior art current limiting fuse constructions in terminating the fusible element. Twisting or distortion of the fusible element at the point of connection within the fuse can result in arcing between turns or damage to the fusible element. Further, since the fusible element is typically fabricated from a silver material, electrical connection of the fusible element by welding can result in damage to the fusible element unless the welding temperatures are held to a relatively low level. Thus, it would be a desirable advance in the art to provide a means of terminating the fusible element that eliminates distortion of the fusible element and facilitates welding of the fusible element.

In addition, since cost is always a factor for any commercial item, it is desirable to provide a current limiting fuse construction that minimizes the number of dissimilar parts and facilitates rapid, low labor cost assembly. Accordingly, it would be a desirable advance in the art to provide a support assembly for a current limiting fuse that reduces the number of dissimilar parts, reduces the labor expense in construction, and maximizes the amount of sand filler material surrounding the fusible element. In addition, it is desirable to assure that the fusible element will be arranged and retained in such a position that the proper concentric alignment of the fusible element with respect to the walls of the current limiting fuse is maintained to prevent localized overheating the walls.

BRIEF DESCRIPTION OF THE INVENTION

In accordance with the present invention, a terminator member for terminating a fusible element in a fuse comprises a flat metallic plate member including a first tab extending outwardly therefrom essentially perpendicular to the path of the fusible element. The first tab has serrations along one surface thereof to facilitate welding of the fusible element to the first tab. Typically, the fuse includes a hollow insulator housing, end walls sealing each end of the insulator housing and a support assembly for supporting the fusible element. A pair of identical metallic plate members each having an opening in the center thereof are mounted at each end of the support assembly by receiving the ends of the support assembly in the openings. The fusible element is connected at each end to the first tab of the plate members and is usually helically positioned along the support assembly.

Each plate member is locked on the ends of the support assembly by a wire retaining ring which engages a groove around the end of the support assembly that extends through the opening in the plate member. Engaging surfaces may be provided in the openings in the plate members to prevent the plate member from being able to be rotated with respect to the support assembly.

A second tab is also provided on the plate members extending outwardly therefrom in a direction opposite to the first tab. The second tab is used to connect the plate members to the end walls of the fuse.

The first tab is essentially perpendicular to the path of the fusible element so that the fusible element can be welded to the first tab without requiring the fusible element to be distorted. Also, the first tab has serrations along one surface thereof to facilitate welding of the fusible element to the first tab at lower temperatures thereby reducing the possibility of damage to the fusible element. Further, to assure the proper physical orientation of the fusible element within the fuse housing, the plate member may also include positioning fingers which extend from the edge thereof to rest against the interior surface of the fuse housing thereby maintaining the fusible element in the proper location. Further, the plate member may include a second tab for connection to the end walls of the fuse to complete electrical connection with the circuit.

Thus, it is a primary object of the present invention to provide a support assembly for a fusible element of a high voltage fuse that allows termination of the fusible element without distorting or excessive bending of the fusible element or damaging the fusible element by excessive welding temperatures.

It is yet another object of the present invention to provide a support assembly for a fusible element of a high voltage which limits the number of dissimilar parts utilized in the construction.

Yet another object of the present invention is to provide a support assembly for a fusible element of a high voltage fuse which permits economical fabrication in assembly at relatively low labor costs.

These and other objects, advantages, and features will hereinafter appear, and for the purposes of illustration, but not of limitation, exemplary embodiments of the present invention are illustrated in the accompanying drawings.

DETAILED DESCRIPTION OF THE PREFERRED EMBODIMENTS

Figure 1:
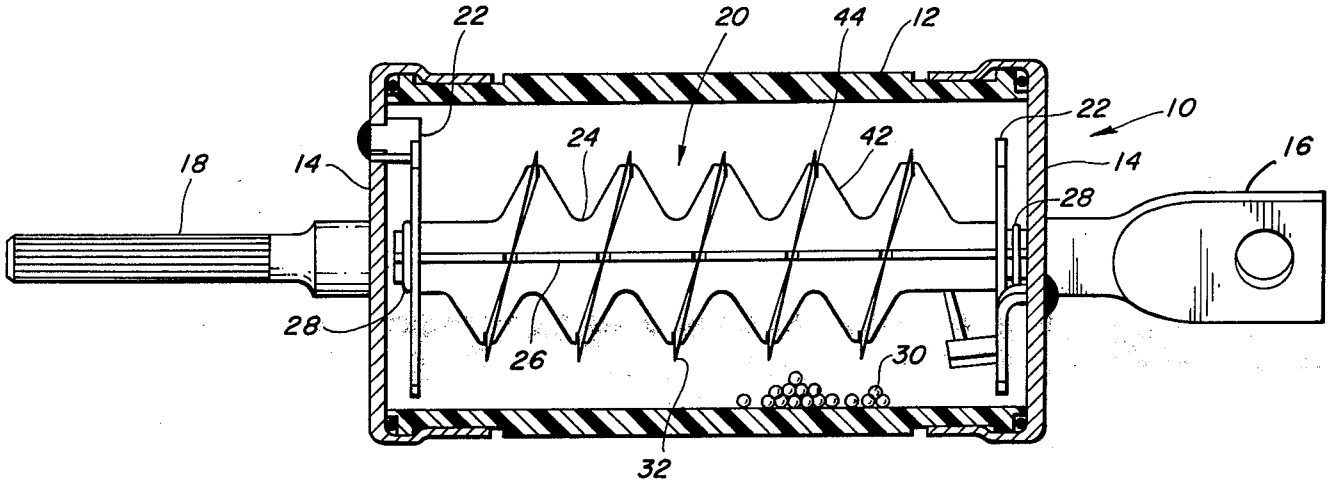
FIG. 1 is a side partially cross-sectional view of one embodiment of the present invention.

With reference to FIG. 1, fuse 10 comprises cylindrical housing 12 fabricated from a suitable electrically insulating material such as plastic resin. Mounted over the end of housing 12 are metallic end ferrules 14 upon which a mounting spade 16 and a mounting stud 18 are attached. Spade 16 and stud 18 are used to mount fuse 10 in an electrical circuit. The method of attaching end ferrules 14 to housing 12 does not form a part of the present invention and is more specifically described in co-pending application Ser. No. 633,293, filed Nov. 19, 1975 assigned to the same assignee as the present invention.

Positioned within cylindrical housing 12 is fusible element support assembly 20. Fusible element support assembly 20 comprises first and second support members 24 and 26. Metallic terminator plates 22 are connected to the ends of support assembly 20, and a metallic snap ring retainer 28 engages the ends of first and second support members 24 and 26 to lock terminator plates 22 to the end of support assembly 20. Cylindrical housing 12 may be filled with a suitable granular elecrically non-conducting insulating material 30 such as silica or quartz sand which entirely surrounds a thin fusible element 32 which is helically edge wound around first and second support members 24 and 26. Fusible element 32 typically is fabricated of silver and is dimensioned to melt when a predetermined magnitude of current is conducted.

Figure 2:
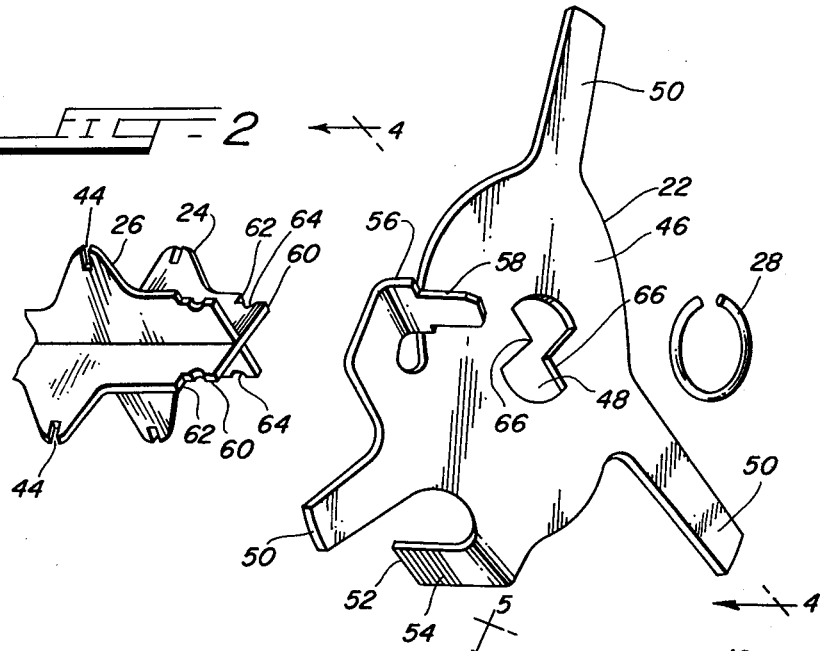
FIG. 2 is an exploded perspective partially fragmentary view of the support assembly of the preferred embodiment of the present invention illustrated in FIG. 1.
Figure 3:
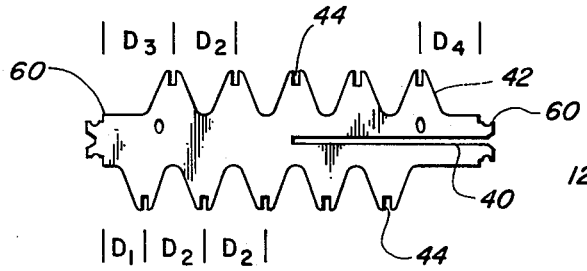
FIG. 3 is a side view of the support member of the support assembly illustrated in FIGS. 1 and 2.

With references to FIGS. 2 and 3, first and second support members 24 and 26 comprise identical thin flat members formed of a suitable electrical insulating material as illustrated in FIG. 3 having a center slot 40 that extends from one end thereof to at least the center thereof. The center slot 40 may conveniently be dimensioned to be slightly wider than the thickness of the support members. Each of first and second support members 24 and 26 have projections 42 extendings from opposite edges thereof in a predetermined positional relationship which will be more specifically described below. In the ends of each of the projections 42 are fusible elements retaining recesses 44 which are dimensioned to receive the fusible element 32. First and second support members 24 and 26 do not form a part of the present invention and are more specifically described and claimed in co-pending application Ser. No. 633,292, filed Nov. 19, 1975 assigned to the assignee as the present invention.

Figure 6:
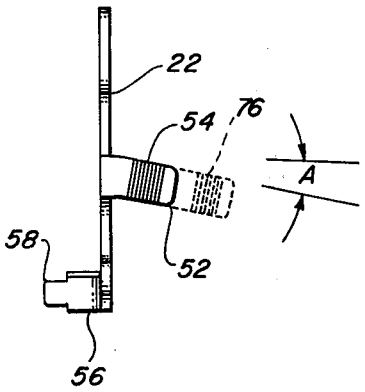
FIG. 6 is an edge view taken substantially along 6—6 in FIG. 1.

With references to FIGS. 2, 4, 5, and 6, metallic terminator plates 22 comprise an essentially flat circular portion 46 having a center keyed opening 48 at approximately the center thereof. Extending from the edges of the flat circular portion 46 at 120° intervals are positioning fingers 50. Also extending from the edge of circular portion 46 is first serrated tab 52. First serrated tab 52 has a series of grooves 54 on one surface thereof which facilitate the welding of fusible element 32 to first serrated tab 52 thereby allowing lower welding temperatures to be utilized reducing the possibility of damage to the fusible element during construction. In addition, first serrated tab 52 is bent to be approximately perpendicular to the surface of circular portion 46 in one plane (see FIG. 5), but is bent at an angle A as illustrated in FIG. 6 from the perpendicular position in the perpendicular plane. Angle A is the angle at which first serrated tab 52 is essentially perpendicular to the path of helically wound fusible element 32 so that the fusible element 32 does not have to be excessively bent or distorted when being welded to first serrated tab 52.

Figure 4:
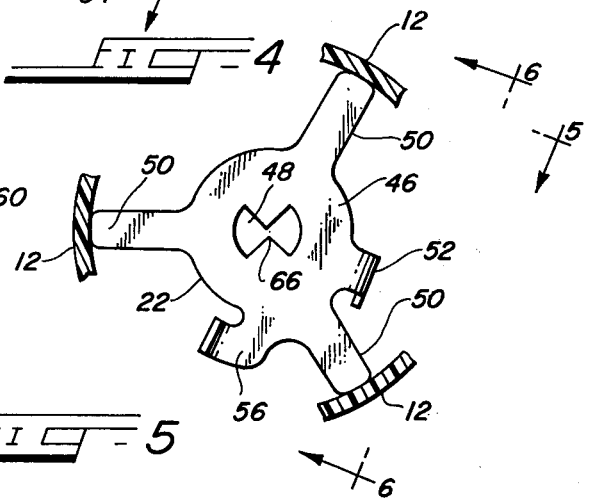
FIG. 4 is a front view of the plate member taken substantially along line 4—4 in FIG. 2.

Also extending from one of the positioning fingers 50 is second mounting tab 56. Second mounting tab 56 is bent perpendicular to the surface of circular portion 46, and has an end portion 58 of reduced dimension that may be inserted through openings in end ferrules 14 and welded thereto to mount the terminator plates 22 within cylindrical housing 12. As illustrated in FIG. 4, positioning fingers 50 are dimensioned so that they will slide into and rest against the interior surface of cylindrical housing 12 so that the entire support assembly 20 is properly positioned within cylindrical housing 12, thus maintaining fusible element 32 at the proper distance from the interior of housing 12.

Each end of first and second support members 24 and 26 have a reduced portion 60 dimensioned to slide into keyed opening 48 in terminator plate 22. Abutting surfaces 62 are provided at the end of the reduced portion 60 which extend beyond the edges of keyed opening 48 to provide an abutting surface against terminator plates 22. The reduced portion 60 also has a groove 64 formed along the opposite edges thereof for receiving snap ring retainer 28.

To assemble support assembly 20, first and second support members 24 and 26, which are identical members as illustrated in FIG. 3, are reversed, rotated until they are perpendicular to one another and then slid one over the other along the center slot 40 until the ends coincide as illustrate in FIGS. 1 and 2. In this position, first and second support members 24 and 26 form a "x" shaped support member. The metallic terminator plates 22 are then positioned over the ends of first and second support members 24 and 26 so that the reduced portion 60 is positioned through keyed opening 48 and snap ring retainer 28 is snapped over the end of first and second support members 24 and 26 until it engages grooves 64 and locks terminator plates 22 to the ends of the support members. In this position, the fusible element retaining recesses on the end 44 on the ends of projections 42 are automatically aligned in the desired helical path of fusible element 32 so that fusible element 32 may be wound around the support assembly 20 and welded to serrated tabs 52.

The retaining recesses 44 align in the proper helical path when first and second support members 24 and 26 are joined along their center slots 40 because of the particular position relationship of the recesses 44. This positional relationship is more specifically described in co-pending application Ser. No. 633,292, filed Nov. 19, 1975.

Use of identical support members 24 and 26, joined together along center slots as described, permits the construction of a support assembly having fewer number of dissimilar parts. Further, terminator plates 22 are identical so that the entire four element assembly is fabricated of only two different parts thereby reducing manufacturing and storage costs.

Keyed opening 48 is formed in an hourglass shape with engaging projections 66 extending from opposite surfaces thereof for engaging the surfaces of first and second support members 24 and 26 so that the members cannot be twisted or rotated with respect to terminator plates 22 once assembly is completed. Further, since first and second support members 24 are relatively thin flat members, their total volume is quite small thereby maximizing the amount of electrically non-conducting material 30 that may be placed around fusible element 32. In addition, since the retaining recesses 44 only engage the fusible element 32 at very narrow points along the length of fusible element 32, there is very little area of the fusible element that is not surrounded by the insulating material 30. Thus, during fuse operation, fulgurite formation is not restricted as the fusible element vaporizes into the insulating material.

Figure 7:
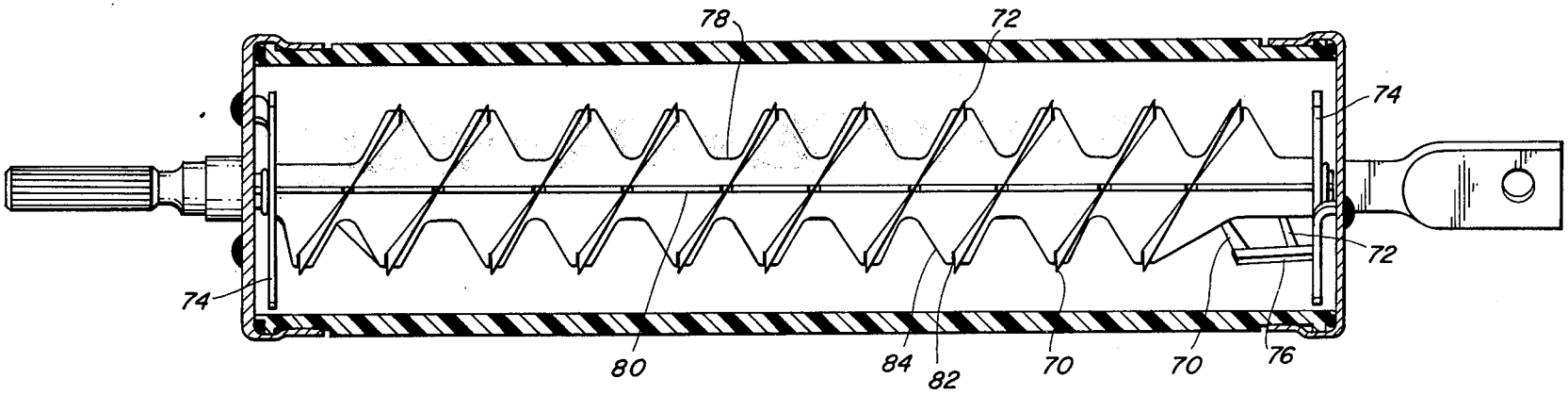
FIG. 7 is a side partially cross-sectional view of an alternative embodiment of the present invention.
Figure 5:
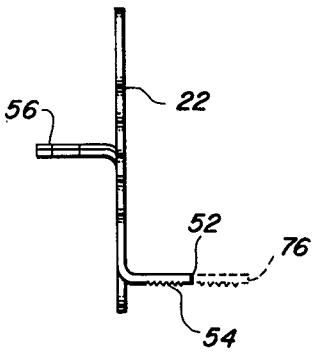
FIG. 5 is an edge view of the plate member taken substantially along line 5—5 in FIG. 4.

With reference to FIG. 7, an alternative embodiment of the present invention is illustrated. This embodiment is substantially the same as the FIG. 1 embodiment, except that provision is made for the helical winding of two fusible elements 70 and 72. Terminator plates 74 are substantially identical to terminator plates 22 in the FIG. 1 embodiment except that the serrated tab 76 is longer than the serrated tab 52 in the FIG. 1 embodiment so that the two fusible elements 70 and 72 can be welded to the same serrated tab. With reference to FIGS. 5 and 6, the relative length of the serrated tab 76 is illustrated in dotted lines.

First and second support members 78 and 80 are substantially the same as first and second support members 24 and 26 in the FIG. 1 embodiment except that the positional relationship of the fusible element retaining recesses 82 in the ends of projections 84 is slightly different in the FIG. 7 embodiment because of the double fusible element relationship. This positional relationship is more specifically described in co-pending application Ser. No. 633,222, filed Nov. 19, 1975.

It should be apparent that the present invention provides substantial advantages in reduced cost and manufacture. The present invention provides simple, easy assembly. Further, the present invention provides for a minimum number of different parts for handling and storage; and thus, minimum storage space is required for parts. Further, the minimum volume of the terminator plates 22 assures full utilization of the fuse volume for the arc quenching sand filler material.

It should be apparent that various changes, modifications, and variations may be made to the embodiments illustrated herein without departing from the spirit and scope of the present invention as defined in the appended claims.

I claim:

1. In a high voltage fuse including a hollow cylindrical insulator housing, metallic end ferrules closing the ends of said housings, a support assembly for supporting at least one helically wound fusible element within the housing, granular electrically non-conducting insulating material in the housing surrounding the fusible element; an improved terminator arrangement for positioning the at least one fusible element within the fuse comprising:

a flat portion having an opening at the center thereof, said opening for receiving an end of the support assembly and said opening having engaging projections extending outwardly toward one another from opposite sides thereof for engaging and positioning the support assembly in a predetermined position;

positioning fingers joined to and extending from said flat portion in the same plane as said flat portion, said positioning fingers positioned around said flat portion, said fingers dimensioned to rest against the interior of the hollow cylindrical insulator housing so that said terminator arrangement is retained in a fixed position with respect to the interior of the housing, said fingers permitting the granular electrically non-conducting insulating material to be inserted around the fusible element after the terminator arrangement has been positioned in the housing;

a first tab joined to and extending from an edge of said flat circular portion in a direction essentially perpendicular to the path of the helically wound fusible element, said first tab having serrations on at least one surface thereof whereby said fusible element can be welded to said first tab without distortion or bending and at reduced welding temperatures;

a second tab joined to and extending from said flat central portion in a direction perpendicular to said flat portion and in an opposite direction from said first tab, said second tab being adapted to be connected with the end ferrules to provide an electrical connection therewith.

2. An improved terminator arrangement, as claimed in claim 1, further comprising a snap ring retainer for engaging the end of the support assembly after the end of the support assembly has been received by the opening in said flat circular portion so that said terminator arrangement is locked to the support assembly in a predetermined positional relationship.

* * * * *

UNITED STATES PATENT AND TRADEMARK OFFICE

CERTIFICATE OF CORRECTION

PATENT NO. : 4,010,438

DATED : March 1, 1977

INVENTOR(S) : Henry W. Scherer

It is certified that error appears in the above-identified patent and that said Letters Patent are hereby corrected as shown below:

Column 3, line 52, "No. 633,292" should read --No. 633,293--.
Column 4, line 54, "No. 633,292" should read --No. 633,293--.
Column 5, line 34, "No. 633,222" should read --No. 633,293--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*